US008858370B2

(12) United States Patent
Siefker

(10) Patent No.: US 8,858,370 B2
(45) **Date of Patent: *Oct. 14, 2014**

(54) KNITTED GOAL SHOT TRAINING SYSTEMS AND DEVICES

(71) Applicant: Aaron Glenn Siefker, Newport Beach, CA (US)

(72) Inventor: Aaron Glenn Siefker, Newport Beach, CA (US)

( * ) Notice: Subject to any disclaimer, the term of this patent is extended or adjusted under 35 U.S.C. 154(b) by 120 days.

This patent is subject to a terminal disclaimer.

(21) Appl. No.: 13/625,684

(22) Filed: Sep. 24, 2012

(65) Prior Publication Data

US 2014/0087894 A1 Mar. 27, 2014

(51) Int. Cl.
*A63B 69/00* (2006.01)

(52) U.S. Cl.
USPC ..... 473/446; 473/422

(58) Field of Classification Search
USPC ..... 473/446, 422, 478, 415; 273/400, 398, 273/402
See application file for complete search history.

(56) References Cited

U.S. PATENT DOCUMENTS

| | | | | |
|---|---|---|---|---|
| 227,262 | A | 5/1880 | Kendall | |
| 364,805 | A | 6/1887 | Conboy | |
| 1,615,931 | A | 2/1927 | Cann | |
| 2,033,408 | A * | 3/1936 | Watterson | 473/508 |
| 3,426,363 | A | 2/1969 | Girard | |
| 3,558,140 | A | 1/1971 | Romeo | |
| 3,840,228 | A | 10/1974 | Greaney | |
| 3,994,423 | A | 11/1976 | Burg | |
| 4,173,337 | A | 11/1979 | Okonowski | |
| 4,212,288 | A | 7/1980 | Lipinski | |
| 4,258,923 | A | 3/1981 | Senoh | |
| 4,864,698 | A | 9/1989 | Brame | |
| 4,921,257 | A | 5/1990 | Heller | |

(Continued)

FOREIGN PATENT DOCUMENTS

CA 1227818 1/1987

OTHER PUBLICATIONS

Webpage Download, CooleyGroup, 2009,www.cooleygroup.com/cooley_product/coolmesh, 6 pages.*

(Continued)

*Primary Examiner* — Kurt Fernstrom
*Assistant Examiner* — M Chambers
(74) *Attorney, Agent, or Firm* — Eric L. Lane

(57) ABSTRACT

Goal shot training systems and devices comprise a training covering having a top edge, a bottom edge, and side edges. The devices are configured to obscure a net of a goal, and the covering is composed of a knit material defining multiple openings such that air passes through the covering. The covering material creates negative viewing space by obscuring visual access behind the training covering and forms at least one user-configurable opening that allows visual access of positive viewing space including a portion of the net of the goal when the covering is affixed to the goal. A user may configure the covering to practice shots originating from different positions on a playing area by adjusting the location of the covering relative to the net of the goal.

10 Claims, 13 Drawing Sheets

(56) References Cited

U.S. PATENT DOCUMENTS

| | | | | | |
|---|---|---|---|---|---|
| D309,486 | S | * | 7/1990 | Guenette et al. | D21/705 |
| 4,948,147 | A | | 8/1990 | Pallanca | |
| 4,963,410 | A | | 10/1990 | Bryant | |
| 5,054,507 | A | | 10/1991 | Sparks | |
| 5,181,725 | A | | 1/1993 | Leras et al. | |
| 5,503,402 | A | | 4/1996 | Moss, Jr. | |
| 5,603,591 | A | | 2/1997 | McLellan | |
| 5,634,640 | A | | 6/1997 | McCarrel | |
| 5,725,444 | A | | 3/1998 | Heden | |
| 5,730,442 | A | * | 3/1998 | Anderson | 273/400 |
| 5,895,330 | A | | 4/1999 | Reilly, Jr. | |
| 5,902,194 | A | * | 5/1999 | Wade | 473/446 |
| D411,267 | S | * | 6/1999 | Oudemool et al. | D21/705 |
| 6,264,572 | B1 | | 7/2001 | Matheson et al. | |
| 6,508,729 | B1 | | 1/2003 | Coltrane et al. | |
| 6,595,878 | B1 | | 7/2003 | Nelson | |
| 6,659,892 | B2 | | 12/2003 | Lytle et al. | |
| 6,846,253 | B1 | | 1/2005 | Szwalek | |
| 6,893,364 | B1 | * | 5/2005 | Grunfeld | 473/446 |
| 6,926,624 | B1 | | 8/2005 | Witzke | |
| 7,037,219 | B2 | | 5/2006 | Pakieser | |
| 7,578,757 | B1 | | 8/2009 | McNary | |
| 7,651,416 | B2 | | 1/2010 | Farquhar | |
| 7,661,679 | B2 | | 2/2010 | Mah et al. | |
| 7,811,184 | B2 | * | 10/2010 | Siefker | 473/446 |
| 8,079,923 | B2 | * | 12/2011 | Siefker | 473/446 |
| 2003/0228941 | A1 | | 12/2003 | Bains | |
| 2004/0235589 | A1 | | 11/2004 | Wedgbury | |
| 2004/0259667 | A1 | | 12/2004 | Berdugo et al. | |
| 2005/0049089 | A1 | * | 3/2005 | Pakieser | 473/446 |
| 2006/0273522 | A1 | * | 12/2006 | Marshall et al. | 273/407 |
| 2007/0191141 | A1 | | 8/2007 | Weber | |
| 2007/0265115 | A1 | | 11/2007 | Farquhar | |
| 2008/0032826 | A1 | | 2/2008 | Mubarak et al. | |
| 2009/0181810 | A1 | * | 7/2009 | Stephenson | 473/446 |
| 2012/0077628 | A1 | | 3/2012 | Siefker | |

OTHER PUBLICATIONS

Webpage Download, Funtec, 2007, www.funtec.co.uk/frames/beach-volleyball-frameset.html, 2 pages.* webpage download, Badinotti, 2008,www.badinotti.com/how__to__measure__meshes.html, 14 pages.*

Webpage Download, chinatexnet2009, 2009, www.chinatexnet.com/Global/Buying-Leads/Buy-100-polyester-hexagonal-mesh-fabric-62202.html, 1 page.*

Webpage Download, Soccergoals2014, Various Screenshots of goals and netting, Dates vary, 10 pages.*

Webpage Download, Walmart2009, 2009, reviews.walmart.com/1336/11045440/mitre-6-x-4-3-in-1-soccer-trainer-reviews/reviews.htm, 2 pages.*

Webpage Download, Cascadenets2004 , 2004, Cascadenets2004 web.archive.org/web/20040820182908/http://cascadenets.com/barrier__netting.php, 3 pages.*

Webpage Download, plasticmesh, 2008, web.archive.org/web/20080705083216/http://www.plasticmesh.net/plastic-mesh/debris-safety-netting.html, 3 pages.*

Webpage Download, gourock, 2009, web.archive.org/web/20101115155306/http://www.gourock.com/hbns.html, 9 pages.*

International Search Report and Written Opinion in related PCT Application.

Franklin Tournament Soccer Rebounder, available at http://www.hayneedle.com/product/tournamentrebounder.cfm.

Lion Sports Heavy Duty Soccer Rebounder, available at http://www.hayneedle.com/product/lionsportsheavydutysoccerrebounder12x6ft.cfm.

Lion Sports 3 in 1 Soccer Trainer, available at http://www.hayneedle.com/product/lionsports3inlsoccertrainer.cfm.

Primed 7' X 5' Soccer Trainer, available at http://www.dickssporting-goods.com/product/index.jsp?productId=20916406.

* cited by examiner

KNITTED GOAL SHOT TRAINING SYSTEMS AND DEVICES

FIELD OF THE DISCLOSURE

The following disclosure relates to goal shot training systems and devices.

BACKGROUND

There are many different sports which involve shooting a ball, puck, or other object into a goal to score points. Such sports, including, but not limited to, soccer, hockey, lacrosse, and water polo, are often big business on the professional and collegiate levels. Accordingly, training players of these sports to improve their skills in scoring goals can be very important to the success of the teams and to the sports businesses' bottom lines.

One way to improve a player's goal shooting ability is to practice shooting with some form of goal training device attached to a goal. Such goal training devices provide targets to aim for and/or a goal cover that rebounds the ball, puck, or other object back to the player so he or she can practice repeated shots. However, most existing goal training devices do not provide a critical feature that is proven to improve a player's goal shooting ability, i.e., a sufficient visual distinction between the training device and the net of the goal.

This visual distinction, manifested in negative viewing space—a color or visual appearance darker than the net so as to obscure the net—and one or more positive viewing spaces—spaces through which the net is easily visible in contrast to the negative viewing space—is very effective in training a player to shoot the ball, puck, or other object at areas of the goal where scoring is more likely. Thus, there is a need for a goal training device that provides a visual distinction using negative and positive viewing spaces.

Another disadvantage of existing goal training devices is that they need a large amount of durable material to extend across the net and effectively rebound the ball, puck, or other object. Thus, the devices can be expensive to manufacture and have a high price point as a result. Therefore, there is a need for a goal training device that is made of less material so it is cheaper to manufacture, yet maintains good durability.

Many of the aforementioned sports are played outside and are therefore subject to the elements, particularly wind. Another disadvantage of existing goal training devices, even those that utilize positive and negative viewing spaces, is that the solid material used for a goal cover is blown by wind and therefore does not maintain its original position in windy conditions. Thus, there is a need for a goal training device that maintains its position in windy conditions.

Accordingly, there is a need for a goal training device that provides a visual distinction using negative and positive viewing spaces. There is also a need for a goal training device that is made of less material so it is cheaper to manufacture, yet maintains good durability. Finally, there is a need for a goal training device that maintains its position in windy conditions. In sum, there is a need for a goal training device that uses negative and positive viewing space to provide a sufficient visual distinction between the device and the net of the goal while also using less material and maintaining its position in windy conditions.

SUMMARY

The present disclosure, in its many embodiments, alleviates to a great extent the disadvantages of known goal training devices by providing goal shot training systems and devices wherein a covering is composed of a knit material defining multiple openings such that air passes through the covering and the covering creates negative space by obscuring visual access behind the training covering and allows visual access of positive space including a portion of the net of the goal. Disclosed devices, systems and methods advantageously use negative and positive space to provide a sufficient visual distinction between the device and the net of the goal while also using less material and maintaining the position of the device in windy conditions. Such devices and systems are used to condition soccer players to make shots at the goal with an improved likelihood of scoring by teaching the soccer players to aim towards the areas of the goal where shots are more likely to score.

Exemplary embodiments of a goal shot training device comprise a training covering having a top edge, a bottom edge, and side edges. The covering is configured to obscure a net of a goal and is composed of a knit material defining multiple openings such that air passes through the covering. The knit material creates negative space by obscuring visual access behind the training covering and forms at least one user-configurable opening that allows visual access of positive viewing space including a portion of the net of the goal when the covering is affixed to the goal. A user may configure the covering to practice shots originating from different positions on a playing area by adjusting the location of the covering relative to the net of the goal.

In exemplary embodiments, the training device further comprises a band of brightly colored material running between at least one side edge and a top or bottom edge of the covering. The covering may be translucent and/or the knit material may be opaque. The covering may also comprise an attachment mechanism configured to be affixed around a top bar of a goal and hold the training cover in place relative to the goal. In exemplary embodiments, the covering is substantially cross-shaped, and the cross shape may have a body that extends substantially from the ground to a crossbar of the goal and a pair of side extensions extending laterally from the body. The openings of the covering may be non-square-shaped and may be substantially teardrop-shaped.

Exemplary embodiments of a goal shooting training system in combination with a goal comprise a goal cover adapted to be used in combination with a goal having two upright posts of equal height, a crossbar having two endpoints, each endpoint terminating at each upright post respectively, and a net affixed to the goal. The crossbar is parallel to the ground at a height equal to the height of the posts. The goal cover has a top edge, a bottom edge, and side edges and is configured to obscure a net of a soccer goal. The goal cover is composed of a knit material defining multiple openings such that air passes through the goal cover.

In exemplary embodiments, the goal cover obscures a majority of the net from view from a playing area, and the knit material is of a color that creates a visual contrast with a minority portion of the net that is viewable from a playing area. The user may configure the goal cover such that the viewable minority portion consists of one or more of: an opening between the one or more edges of the goal cover and an upright post, an opening between the one or more edges and the crossbar, or an opening between the one or more edges and the ground.

The goal cover can be configured for shots originating substantially directly in front of the goal consisting of positioning the body and arms of the goal cover whereby the covering obscures the net except for openings at the top right corner, the top left corner, the bottom right corner, and the bottom left corner of the goal. The goal cover can also be configured for shots originating at a penalty kick position consisting of positioning the goal cover such that it obscures the net except for a pair of openings are created along each post from the ground to the cross bar. In addition, the goal cover can be configured for shooting shots from the side of the field consisting of positioning the goal cover such that it obscures the net except for an opening created along the post furthest from the origin of the shot, the opening being from the ground to the cross bar.

In exemplary embodiments, the goal cover is substantially cross-shaped, and the cross shape has a body that extends substantially from the ground to the crossbar and a pair of arms extending laterally from the body. The openings of the goal cover may be non-square-shaped and may be substantially teardrop-shaped. The goal cover may be translucent and/or the knit material may be opaque. In exemplary embodiments, the goal shooting training system further comprises a band of brightly colored material running between at least one side edge and a top or bottom edge of the covering. In exemplary embodiments, the goal cover maintains its original position in windy conditions.

BRIEF DESCRIPTION OF THE DRAWINGS

The above-mentioned features and objects of the present disclosure will become more apparent with reference to the following description taken in conjunction with the accompanying drawings wherein like reference numerals denote like elements and in which.

DETAILED DESCRIPTION

Figure 1:
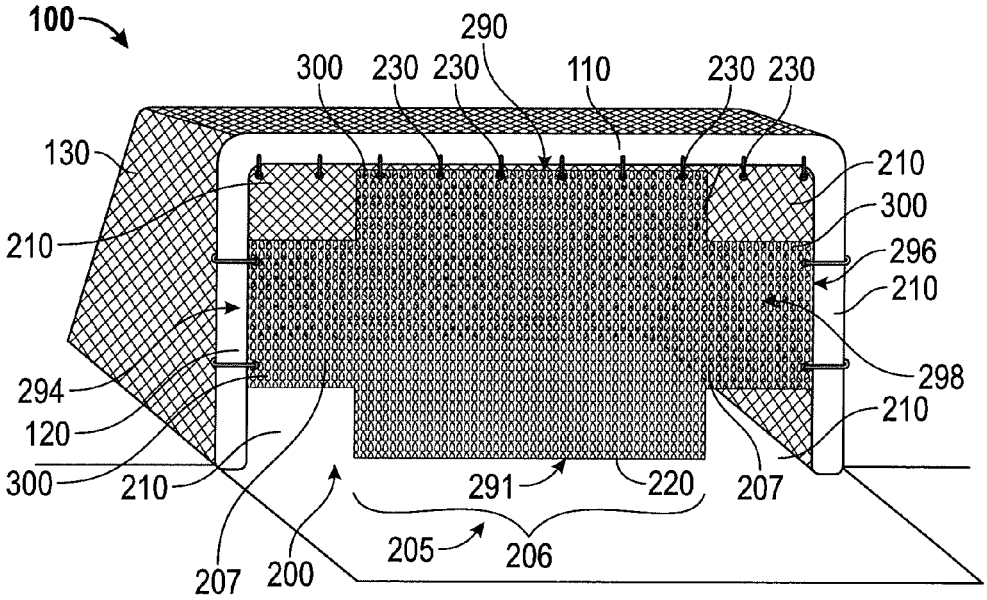
FIG. 1 is a front view of an exemplary embodiment of a goal shot training system in accordance with the present disclosure.

In the following detailed description of embodiments of the disclosure, reference is made to the accompanying drawings in which like references indicate similar elements, and in which is shown by way of illustration specific embodiments in which disclosed systems and devices may be practiced. These embodiments are described in sufficient detail to enable those skilled in the art to practice the embodiments, and it is to be understood that other embodiments may be utilized and that logical, mechanical, functional, and other changes may be made without departing from the scope of the present disclosure. The following detailed description is, therefore, not to be taken in a limiting sense, and the scope of the present disclosure is defined only by the appended claims. As used in the present disclosure, the term "or" shall be understood to be defined as a logical disjunction and shall not indicate an exclusive disjunction.

The term "negative viewing space" as used in this application refers to a color or visual appearance darker than the net so as to obscure the net from view by a player using disclosed embodiments of goal shot training systems and devices. The term "positive viewing space" as used in this application refers to a region of a goal that a player aims for when shooting and can see as spaces through which the net is easily visible in contrast to the negative viewing space.

Players of soccer, lacrosse, water polo, hockey and other sports train with the end goal of scoring goals by moving a ball, puck or other object into a goal. The goal is a target defined by two posts and a cross bar connecting the posts. The posts of a regulation soccer goal are 24 feet apart, and the cross bar is 8 feet high. Typically, a net is hung behind the goal to stop the ball and more easily determine when a goal is scored.

Soccer players, with the exception of the goalkeeper, may use any part of their body except for their arms and hands to move the ball towards the goal. The goalkeeper comprises the last defense and may use any part of their body, including their arms and hands, to prevent the opposing players from scoring a goal. The goalkeeper is positioned in front of the goal and presents an obstacle that opposing players must overcome.

Under most circumstances, the ball is moved into the goal by kicking the ball or by striking the ball with the head—"heading the ball." Soccer players develop the ability to precisely shoot the ball though the goal. In order to strike the ball with precision and hard enough to evade the goalkeeper, the players often "set up the shot." To set up the shot, the player looks up to the goal to aim the shot and decide how the ball will be struck. Thereafter, the soccer player looks down at the ball immediately prior to kicking it to accurately strike the ball, allowing the player to vary the spin and vertical elevation of the shot. The entire process may take less than a second.

Thus, most of the "decisions" involved in setting up the shot are instinctive as a result of long hours of practice.

The process of looking up and taking aim occurs in a relatively short period of time. Players must therefore train to rapidly recognize and make adjustments to their shots in short time periods of often less than a second. Players' eyes tend to be attracted first to the movement of the goalkeeper after setting up the shot. Because players tend to shoot the soccer ball at the first object they see in the goal area, they tend to shoot the ball directly at the goalkeeper, the area where the player is least likely to score a goal. However, if soccer players are trained to first see a different part of the goal where the likelihood of scoring is increased, the players will have a better likelihood of scoring. For example, if a soccer player trains to see to the corners of the goal first after setting up the shot, rather than seeing the goalkeeper first, the likelihood of scoring a goal is greatly increased. Thus, a new method of training soccer players is needed, which helps condition players to see a higher likelihood of scoring areas of the goal first and to shoot at these areas.

The present disclosure is designed to train soccer players to see parts of the goal in which the player is most likely to score. The systems and methods of the present disclosure deemphasize the areas covered by the goalkeeper using negative viewing spaces and emphasize the areas in which players are most likely to score goals using positive viewing spaces. Consequently, when a soccer player looks up to the goal after setting up the shot, the players become conditioned to see the areas most likely to score a goal and will consequently shoot the ball towards those areas rather than at the goalkeeper.

An exemplary embodiment of a goal shot training device or training system is shown in FIG. 1. Goal shot training device 200 comprises a goal cover or training covering 205. The training covering 205 has a top edge 290, a bottom edge 292, and first and second side edges 294, 296. The training covering may be made of a knit material 298. The knit material 298 may be a cloth (such as canvas), vinyl, polypropylene, polyethylene, or could be any natural or synthetic textile or combination thereof including, but not limited to, plant-based textiles such as grass, rush, hemp, or sisal, mineral-based textiles such as asbestos, basalt fibre, glass fibre, metal fibre, metal foil, or metal wire, and/or synthetic textiles such as polyester fibre, aramid fibre, acrylic, nylon, spandex, olefin fibre, ingeo, lurex, or carbon fibre or any other material that can be knit into a covering defining openings and is able to withstand the impact of soccer balls without tearing or becoming dislodged. In exemplary embodiments, the knit material 298 is substantially opaque to effectively create negative viewing spaces 220 that obscure the net of the goal.

Figure 11A:
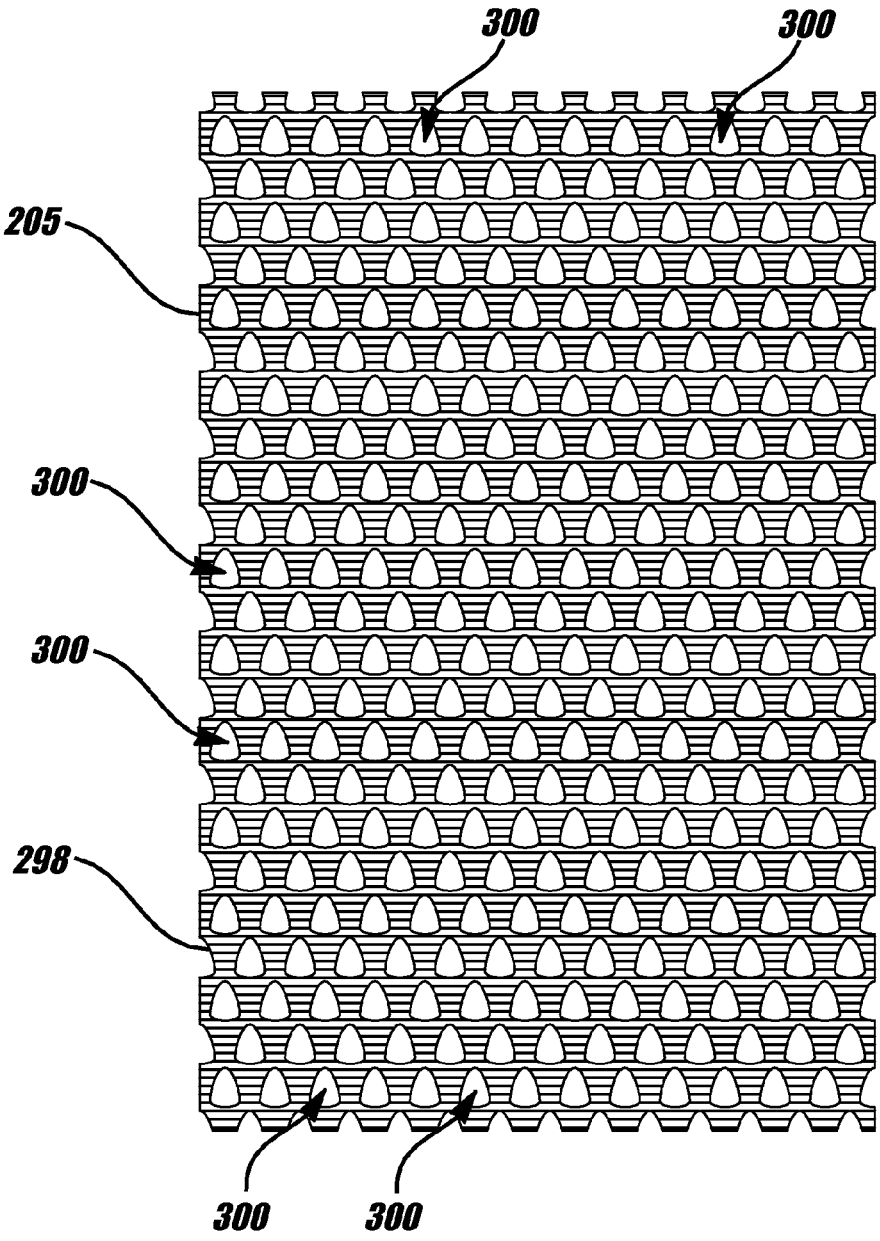
FIG. 11A is a detail view of an exemplary embodiment of a training covering in accordance with the present disclosure.
Figure 11B:
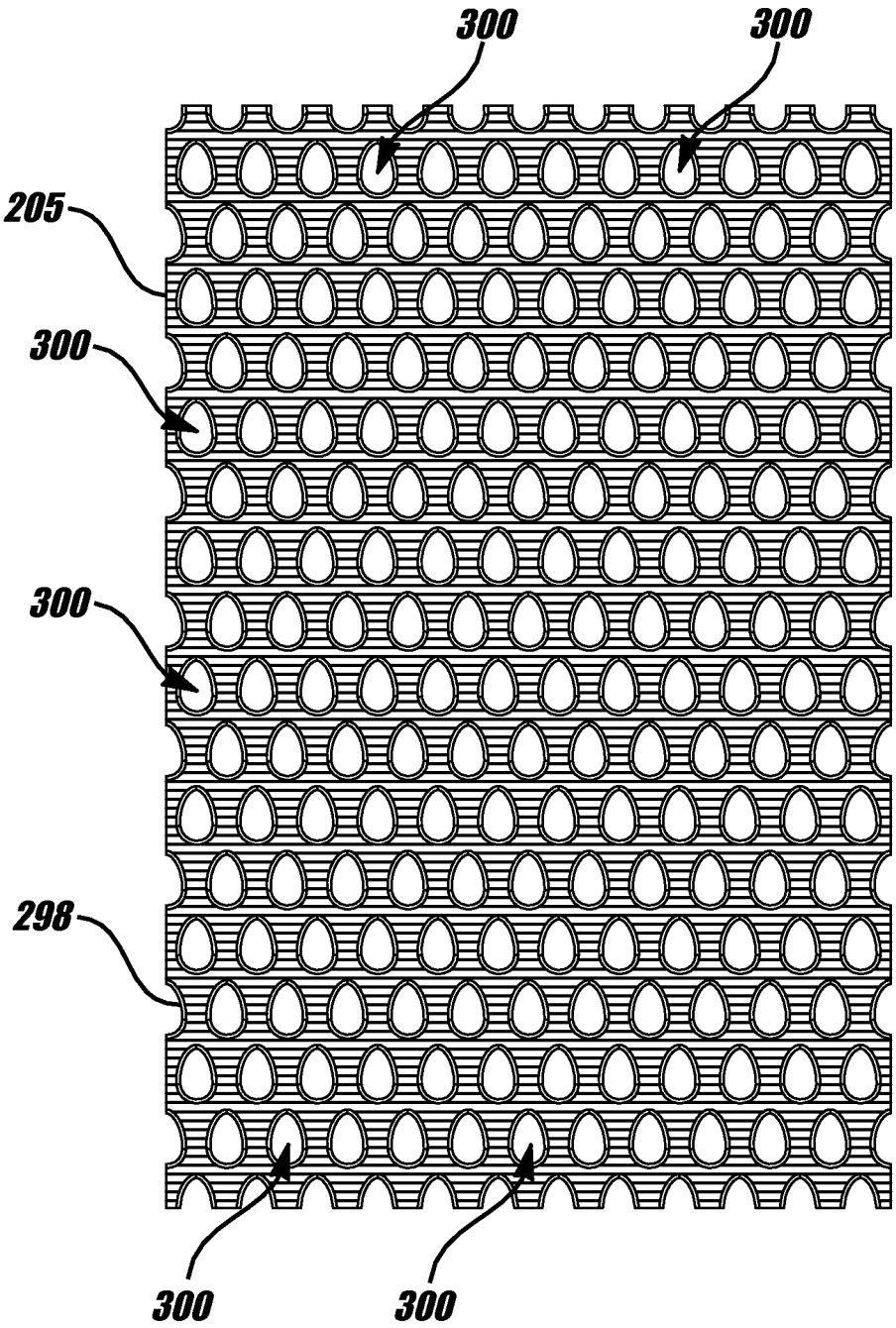
FIG. 11B is a detail view of an exemplary embodiment of a training covering in accordance with the present disclosure.

As best seen in FIGS. 11A and 11B, the knit material 298 of the training covering 205 defines multiple openings 300. The openings 300 are sized and shaped so they do not blend in with the typically square-shaped holes of nets of goals used in soccer, hockey, lacrosse, water polo, etc. More particularly, exemplary openings 300 are not square-shaped so they can be easily visually differentiated from the holes in most goal nets. In exemplary embodiments, the openings 300 in the knit material 298 are substantially egg-shaped, as best seen in FIG. 11B or teardrop-shaped, as best seen in FIG. 11A, but the openings may be any desired shape so long as the shape differs enough from that of the holes of the net of the goal being used to provide a visual distinction between the training covering 205 and the net.

The openings 300 in the knit material 298 may also vary in size and can be any size so long as they allow air to pass through while maintaining a sufficient visual distinction between the training covering 205 and the net of goal being used. In exemplary embodiments, the openings 300 are up to about ¼ inch in length or height and up to about ⅛ inch wide, dimensions significantly smaller than, e.g., soccer goal nets, which typically have holes that are 4×4 inches. However, the openings 300 in the knit material 298 could be larger, up to about 3.8 inches by 3.8 inches, so long as they are smaller than the openings of the net used for the goal such that they create visual distinction between the training covering 205 and the goal.

The knit material 298 and openings 300 therein provide a number of advantages. For instance, the openings 300 allow air to pass through so the goal shot training device 200 maintains its original position when used outdoors in windy conditions. With the multiple openings 300 facilitating passage of the wind, the training covering 205 remains relatively still instead of flapping and moving around in the wind. The knit material 298 is also strong and heavy enough to add rigidity, thereby enhancing the ability of the training covering 205 to maintain its original position in inclement weather. Moreover, due to the openings 300, the knit material 298 creates a substantial degree of visual distinction with less material, thereby reducing manufacturing costs.

Perhaps most importantly, the openings 300 are small enough such that there is enough surrounding knit material 298 to provide substantial cover area to obscure most of the goal and create a visual distinction or contrast with a minority portion of the net viewable by a player from a playing area, i.e., to create negative viewing space. More particularly, the training covering 205 creates both positive viewing spaces 210 and negative viewing spaces 220. These spaces are designed to attract the eye or repel the eye, respectively. In exemplary embodiments, the effect of the knit material 298 and openings 300 is to make the training covering 205 translucent. One important metric for determining the optimal size of the openings 300 to create positive 210 and negative viewing spaces 220 is the percentage of light transmitted through the training covering 205. The percentage of light transmission should create a visual distinction between the training covering 205 and the net of the goal behind it and could range from about 5% to about 90%, with exemplary embodiments having a light transmission percentage between about 25% and 75%.

FIG. 1 also shows goal 100. Goal 100 comprises the target area of goal 100 defined by two posts 120 connected by crossbar 110 on the top. The soccer end line comprises the bottom of the goal. Goal shot training device 200 is provided to condition players to shoot towards the most effective areas in goal 100. According to embodiments, goal cover 205 is connected to crossbar 110. Goal cover 205 connects to goal shot training device connectors 230, which are installed on crossbar 110. Goal shot training device connectors 230 comprise hooks and openings, for example. If hooks, goal cover 205 may have grommeted openings which may be placed over goal shot training device connector 230 and which correspond positionally to the location of goal shot training device connector 230 on crossbar 110. In an embodiment goal shot training device connector 230 comprises openings. Ropes, cords, strings, hooks, wires, or equivalents may be inserted into the opening. The ropes, cords, strings, hooks, wires, or equivalents are also connected to goal cover 205, as would be known to a person of ordinary skill in the art for the purpose of hanging a curtain-like structure. Other connection methods, such as with rope weaving or lashing are common in the art and known to a person of ordinary skill in the art.

According to an embodiment, positive viewing spaces 210 comprise openings in goal cover 205. These openings allow both a soccer ball to pass into the area behind the goal. More importantly, the openings allow the soccer player to quickly locate an unobstructed target to aim for. That is, when a soccer player looks to goal 100 after setting up the shot, positive viewing spaces 210 are the goal areas in which the soccer player can see net 130. By training themselves to look for openings in goal cover 205, soccer players become conditioned to look first for the high probability scoring areas of the goal after setting up the shot, which increases the likelihood of shooting the balls to those areas. Although negative viewing spaces 220 are generally intended to be covered, positive viewing spaces 210 may either be covered with a pattern or color, such as a light color, that causes the player to look first at the positive viewing space or form openings in goal cover 205 through which a soccer ball may travel to simulate actually kicking a scoring shot.

Because goal shot training device 200 is placed very close to the imaginary plane the ball must cross to score a goal, use of goal shot training device 200 conditions a player to aim at areas of the goal where a scoring shot is the likeliest. Moreover, as part of the conditioning process and when the positive viewing spaces 210 are open, the conditioning is reinforced by correctly placed shots actually "entering" the goal and stopped by the net. Conversely, when the shot is incorrectly placed, goal shot training device 200 stops the ball as if an actual goal keeper had stopped the ball. The cumulative effect conditions the players to shoot for the spaces where the player is "rewarded" by kicking the ball past goal shot training device 200 and into the goal as if a goal keeper were present. Thus, when goal shot training device 200 is absent, the player will be preconditioned to shoot at the spots where they are most likely to score.

According to embodiments, positive viewing spaces 210 comprise a uncovered, light, or bright colored areas of goal cover 205. After setting up the shot, players will be instructed to look for light or bright spaces and shoot for those areas. Consequently, the players will become conditioned to shoot to the light or bright colored areas of goal shot training device 200, even when the goal shot training device 200 is not in place.

Referring still to an exemplary embodiment represented in FIG. 1, negative viewing spaces 220 of goal shot training device 200, are designed to be deemphasized when a player looks to goal 100 after setting up a shot. De-emphasis of negative viewing spaces 220 conditions players to first see positive viewing spaces 210 by instinct. Thus, the soccer player will be less likely to shoot at negative viewing spaces 220 and more inclined to initially see positive viewing spaces 210 and shoot to those areas. In embodiments, negative viewing spaces 220 are darkly colored spaces. When a player looks to the goal after setting up the shot, they will be trained to look for positive viewing spaces 210. Consequently, the player will become conditioned to avoid the negative, or dark colored, viewing spaces 220 altogether in favor of positive, or light colored/open viewing spaces 210 when they look up to goal 100 after setting up a shot in the absence of goal shot training device 200.

Moreover, according to embodiments, negative viewing spaces 220 may be shaped to imitate the range of a goalkeeper. For example, negative viewing spaces 220 may be roughly cross-shaped to imitate the range over which a goalkeeper is likely to make a save. For example, goal cover 205 comprises goal cover central portion 206 roughly imitating the range of a goal keeper's body, and goal cover side extensions 207 roughly imitating the range of a goal keeper's arms. Thus, soccer players who train with goal shot training device 200 will become conditioned to shoot to areas where the goalkeeper is less likely to stop shots, improving their chances for scoring a goal by aiming the ball to areas of the goal that have a higher likelihood of successfully passing through the goal.

Figure 2:
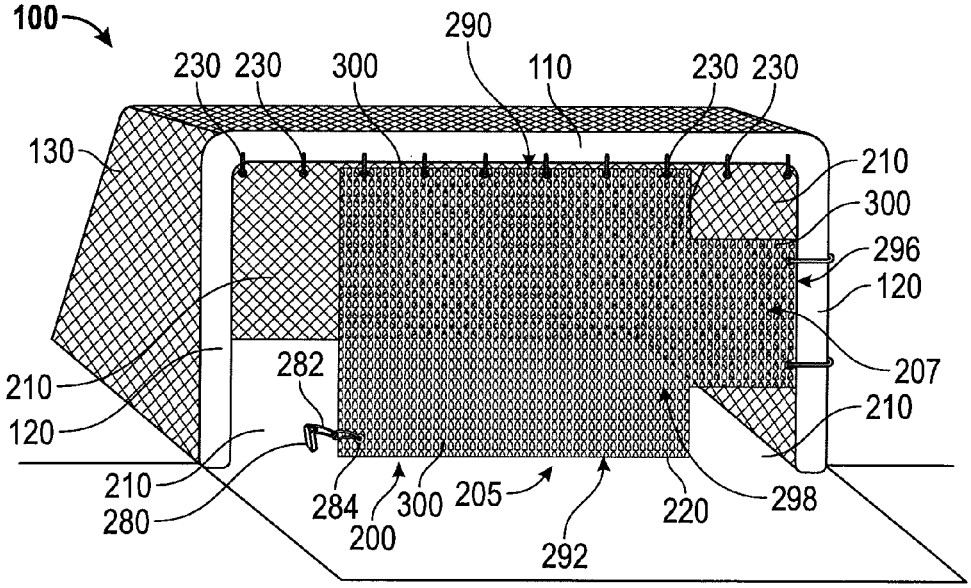
FIG. 2 is a front view of an exemplary embodiment of a goal shot training system in accordance with the present disclosure.

According to embodiments shown in FIG. 2, goal shot training device 200 may be positioned differently depending on the angle of the shot. When a shooter moves the ball to the right of the field and goal, for example, the goalkeeper typically shifts slightly to the shooter's right. The keeper's shift reflects the greater difficulty in shooting a ball to the far post 120 versus shooting the ball to the near post 120. By shifting positions, the goalkeeper reduces likelihood of a scoring shot by covering the areas comprising the easiest shots for the shooter over the entire area of goal 100.

To reflect the changed likelihood for scoring shots induced by the goalkeeper's shift in position, goal shot training device 200 may be modified, e.g., by repositioning, to reflect the changed shot success likelihood circumstances induced by the goalkeeper's change in position, according to embodiments. When the shooting team moves the ball to the right side of the field, the goalkeeper moves to the right as well, creating a space in the left part of goal 100 that cannot be covered by the keeper. Thus, goal shot training device 200 may be repositioned so that the negative viewing spaces 220 would be positioned in the right of the goal, while creating additional positive spaces 210 in the left part of the goal where the goalkeeper cannot easily protect, as shown in FIG. 2.

According to an embodiment, a portion of goal cover 205 may be hidden behind the remainder of goal cover to simulate the opening of additional positive viewing space 210 that would exist in the left part of goal 200 when the shot comes from the right side of the field, as previously described. According to this embodiment, a portion of goal cover 205 with negative viewing space 220 may be folded backwards and suspended from the same goal shot training device connectors 230 as other portions of goal cover 205. The net result "removes" a portion of goal cover 205 containing a portion of negative viewing space 220. Thus, when shooting from the sides, shooters would be conditioned to shoot towards the far post by conditioning themselves to look first at far post 120, corresponding to positive viewing spaces 210. The process is reversed for shots from the left side of the soccer field.

The change in positive viewing spaces 210 reflecting the variations in likelihood of successful shots at the goal, measured as a function of where the ball is shot with respect to areas of the goal, may be accomplished by shifting goal cover 205 according to an embodiment. Shifting goal cover 205 moves negative viewing spaces 220 to the right from the shooter's perspective, creating additional positive viewing space 210 in the left part of the goal. Thus, additional positive viewing spaces 210 may be accomplished by shifting entire goal cover 205, according to the exemplary embodiment.

Figure 3:
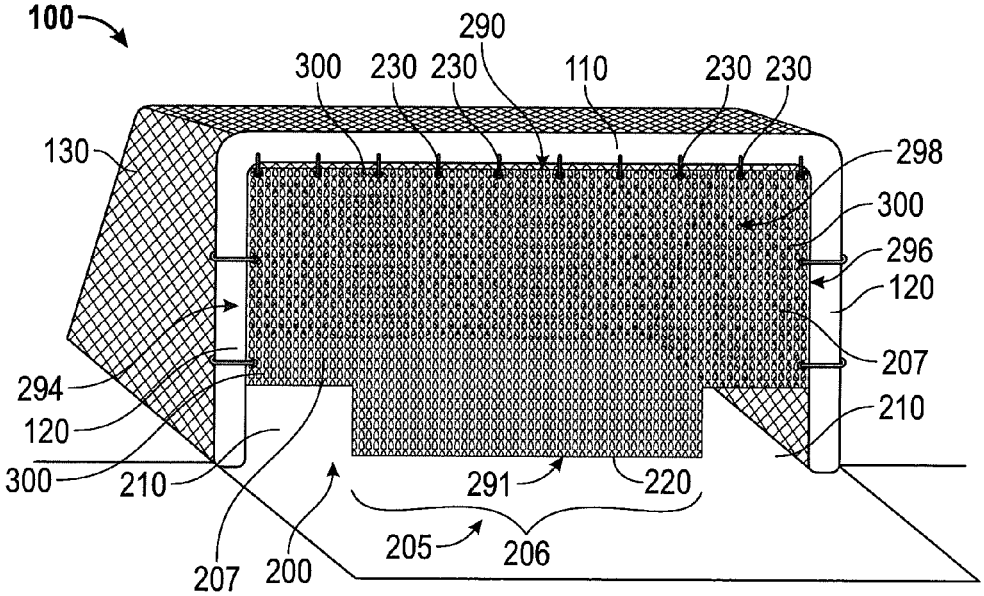
FIG. 3 is a front view of an exemplary embodiment of a goal shot training system in accordance with the present disclosure.

According to an embodiment shown in FIG. 3, the teachings of the present disclosure may also be used to condition players to shoot specific type shots. For example, FIG. 3 shows goal cover 205 where positive viewing spaces 210 exist only close to the ground. Using this embodiment, players with difficulty shooting low shots may train and condition themselves to shoot shots at goal 100 close to the ground. Other, similar embodiments, such as shooting for the top corners of the goal may similarly be used and would be well known to a person of ordinary skill in the art.

Figure 4:
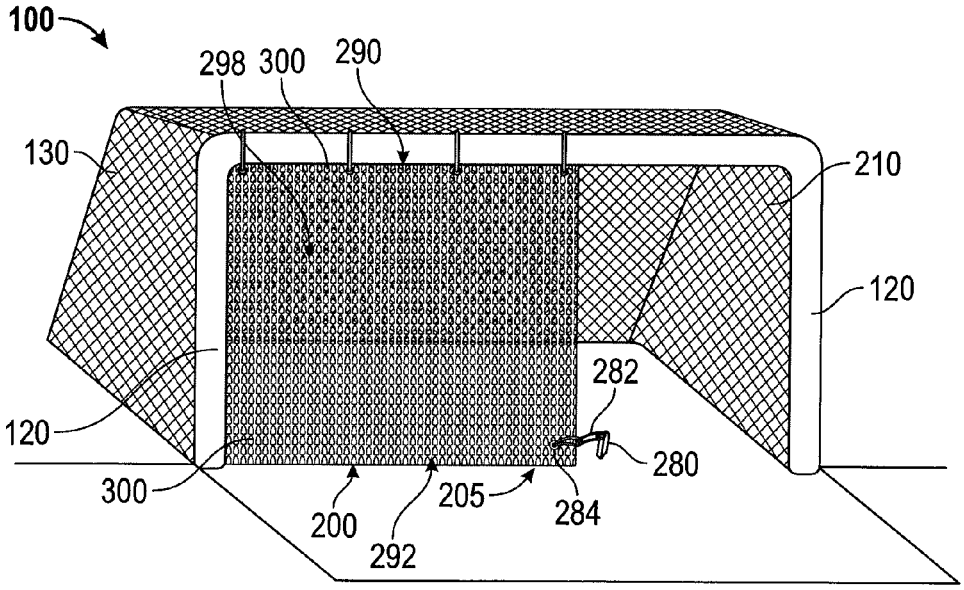
FIG. 4 is a front view of an exemplary embodiment of a goal shot training system in accordance with the present disclosure.
Figure 5:
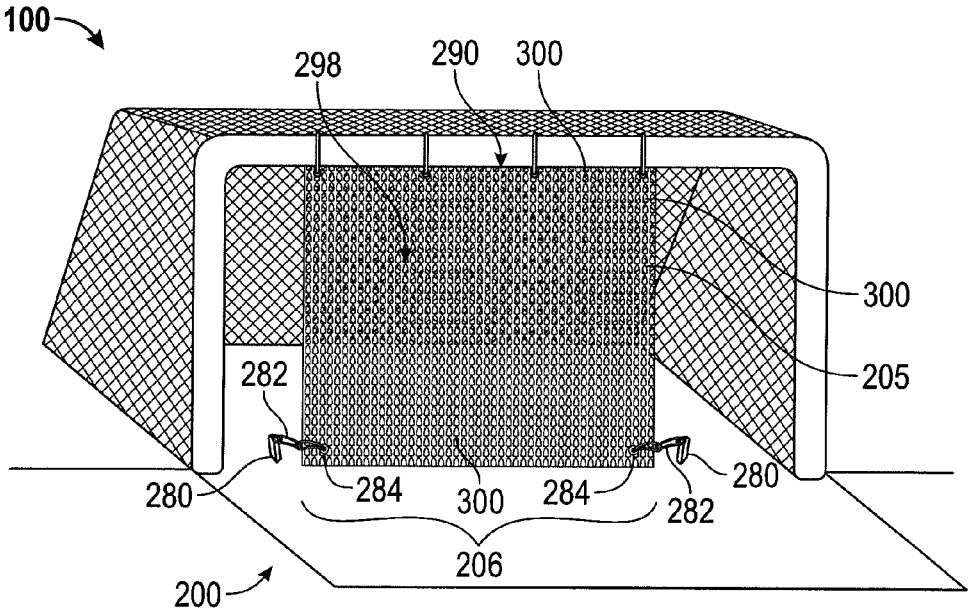
FIG. 5 is a front view of an embodiment of a goal shot training system in accordance with the present disclosure.

Similarly according to embodiments and as illustrated in FIG. 4, players may be conditioned to shoot at the far post of the goal by configuring goal shot training device 200 to completely obscure one side of the goal thereby forcing the player to shoot at the opposite side. According to similar embodiments and as illustrated in FIG. 5, goal shot training device 200 may be deployed asymmetrically across the goal depending on the specific training goals sought, as will be known and understood by artisans.

Figure 6A:
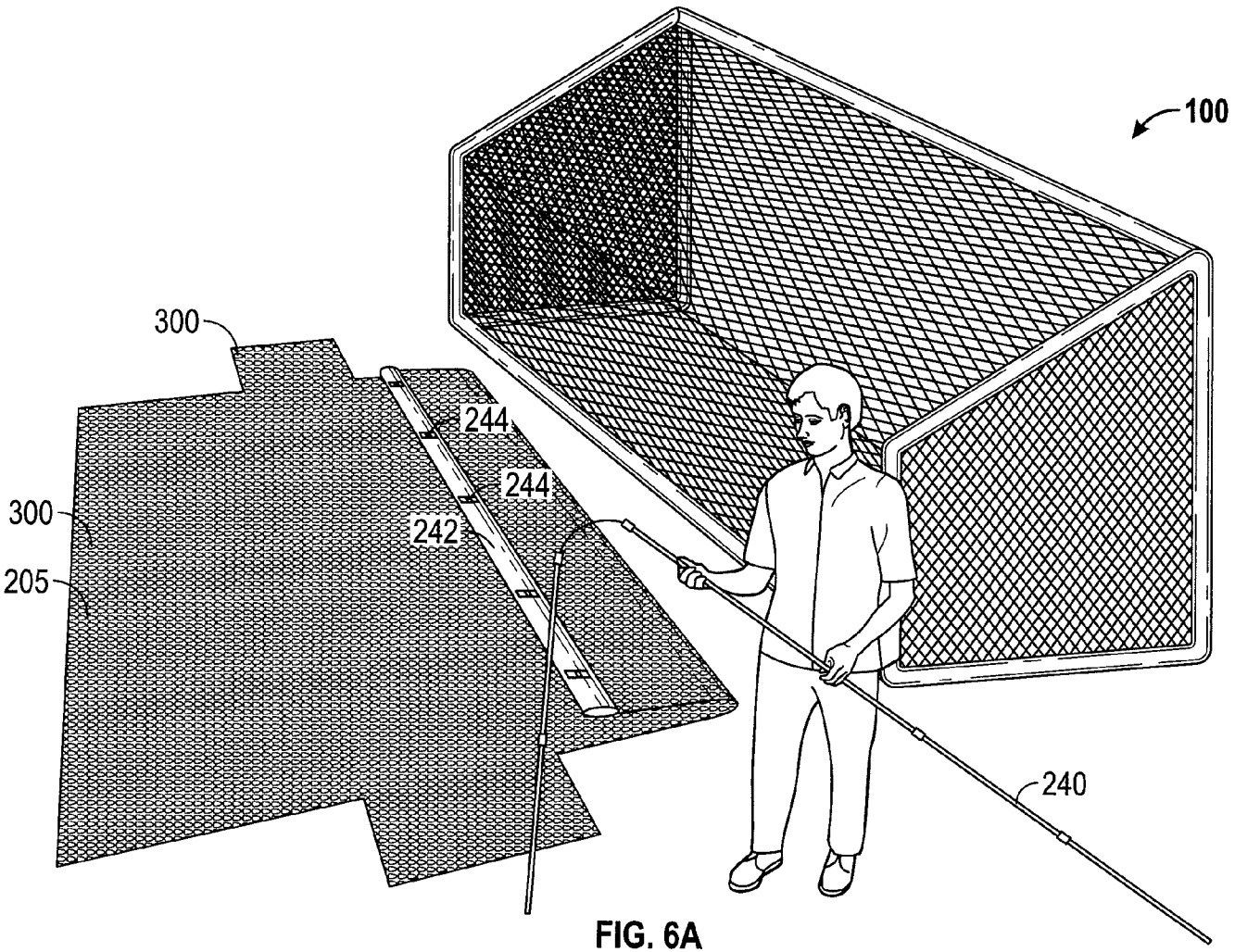
FIGS. 6A and 6B are perspective views of an exemplary embodiment of a method for connecting a goal shot training device to a goal in accordance with the present disclosure.
Figure 6B:
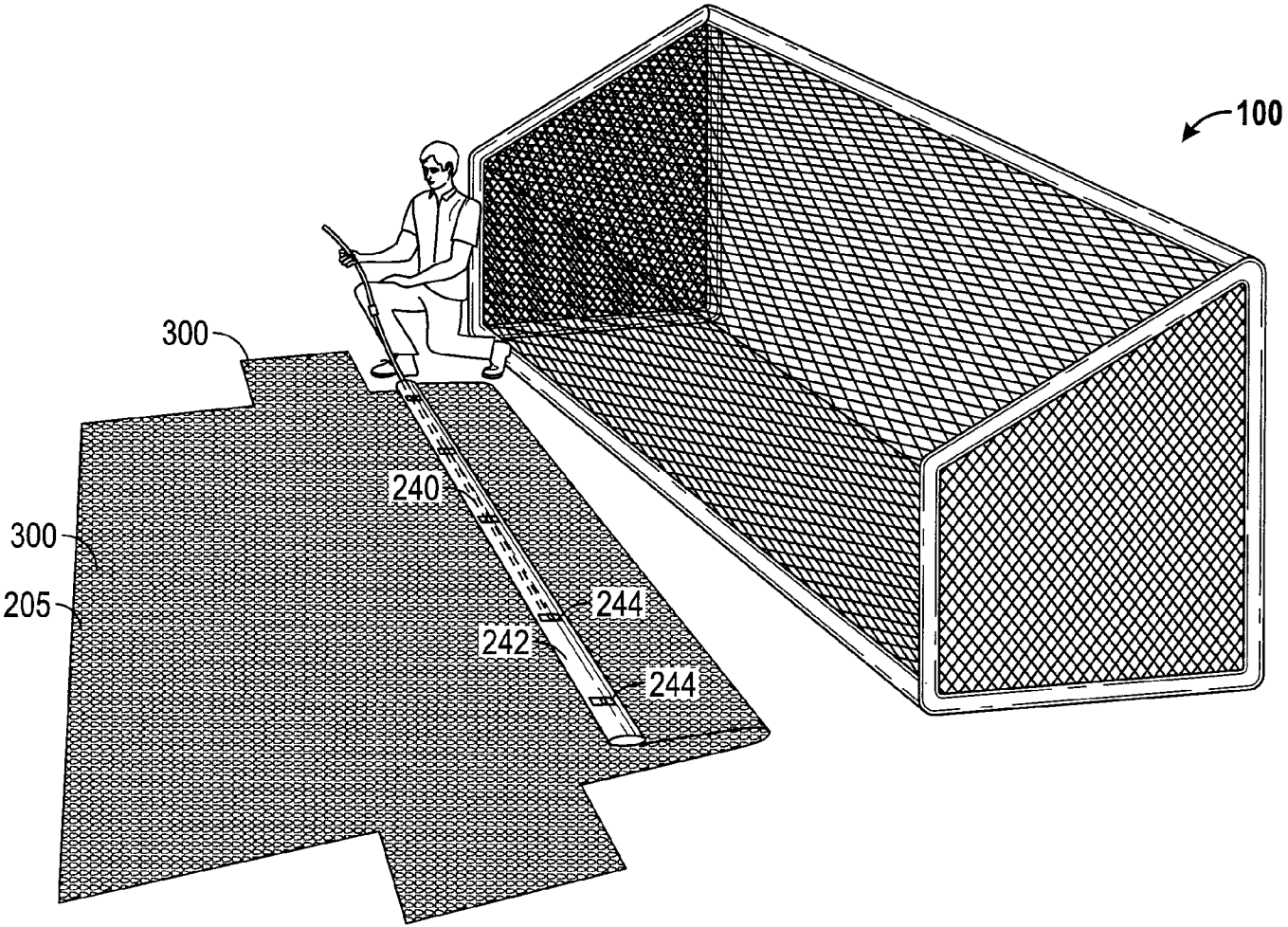

According to embodiments, assembly of goal shot training device 200 is accomplished by inserting one or more supporting members and affixing to posts 120 and cross bar 110 of goal 100 with straps. According to embodiments shown in FIG. 6A, installation of goal shot training device 200 is accomplished first by placing one or more supporting members 240, 260 (see FIG. 8) into receivers 242 disposed in goal cover 205. Support members 240, 260 comprise devices, such as poles, that provide increased rigid structure to the goal shot training device 200. For example, collapsible fiberglass poles that are often used as tent poles may be used as support members 240, 260. Support members 240, 260 may be disposed at the top, bottom, or along the vertical sides of goal cover central portion 206 or goal cover side extension 207 sides, according to embodiments.

Receivers 242 comprise pockets configured to receive supporting members 240. According to embodiments, receivers 242 are disposed across the top and bottom of goal cover 205. According to similar embodiments, receivers 242 are disposed across the top, bottom, and along the vertical sides of goal cover central portion 206.

Figure 7A:
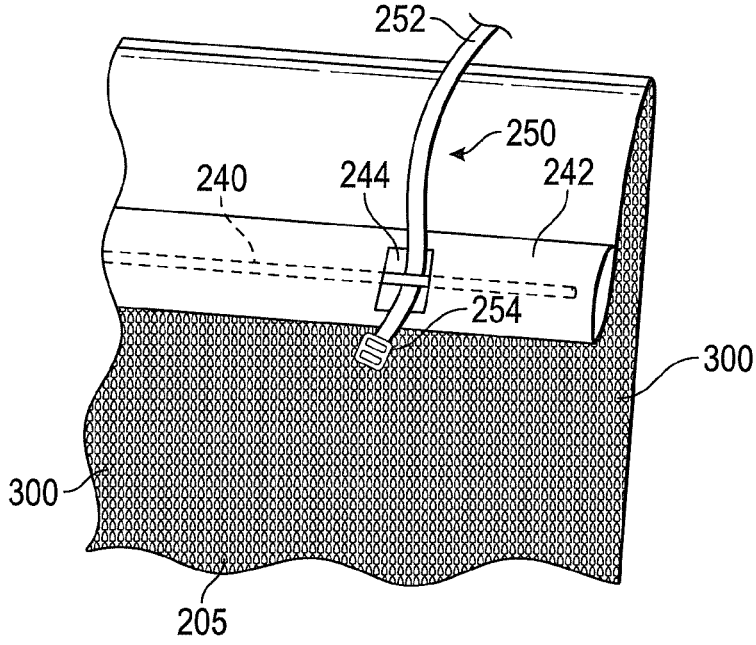
FIGS. 7A and 7B are perspective views of an exemplary embodiment of a method for connecting a soccer goal training device to a goal in accordance with the present disclosure.
Figure 7B:
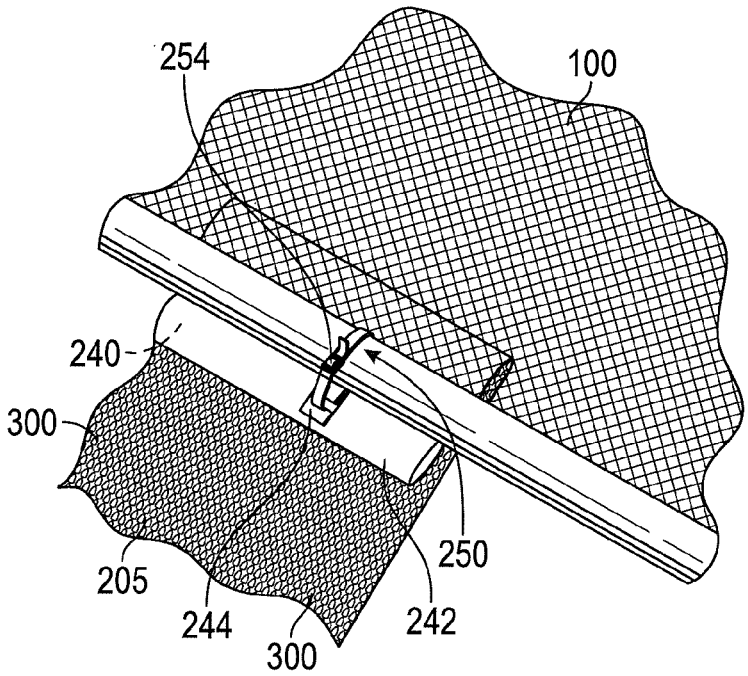

According to embodiments for connecting goal shot training device 200, after supporting members 240 are disposed into receivers 242 along the portion of goal cover 205 that is to be connected to goal 100 crossbar 110, goal cover 205 is connected to goal 100. One or more straps 250 connect goal cover 205 to goal 100. To connect straps 250 to goal cover 205, one or more connection openings 244 are disposed along receivers 242, which exposes supporting member 240. Each strap 250 is threaded between supporting member 240 and goal cover 205 at at least one connection opening 244, as illustrated in FIG. 7A. Thereafter, strap is placed around goal 100 crossbar 110; the loose end of strap 252, according to embodiments, is connected to strap connector 254 and tightened, whereby goal cover 205 is firmly connected to goal 100.

According to embodiments, straps 250 are not connected to support member 240 at bottom of goal cover 205. Similarly according to embodiments, straps may be pre-attached to goal cover side extensions 207 for connection to side posts 120 of goal 100, or may be attached as disclosed above.

Figure 8:
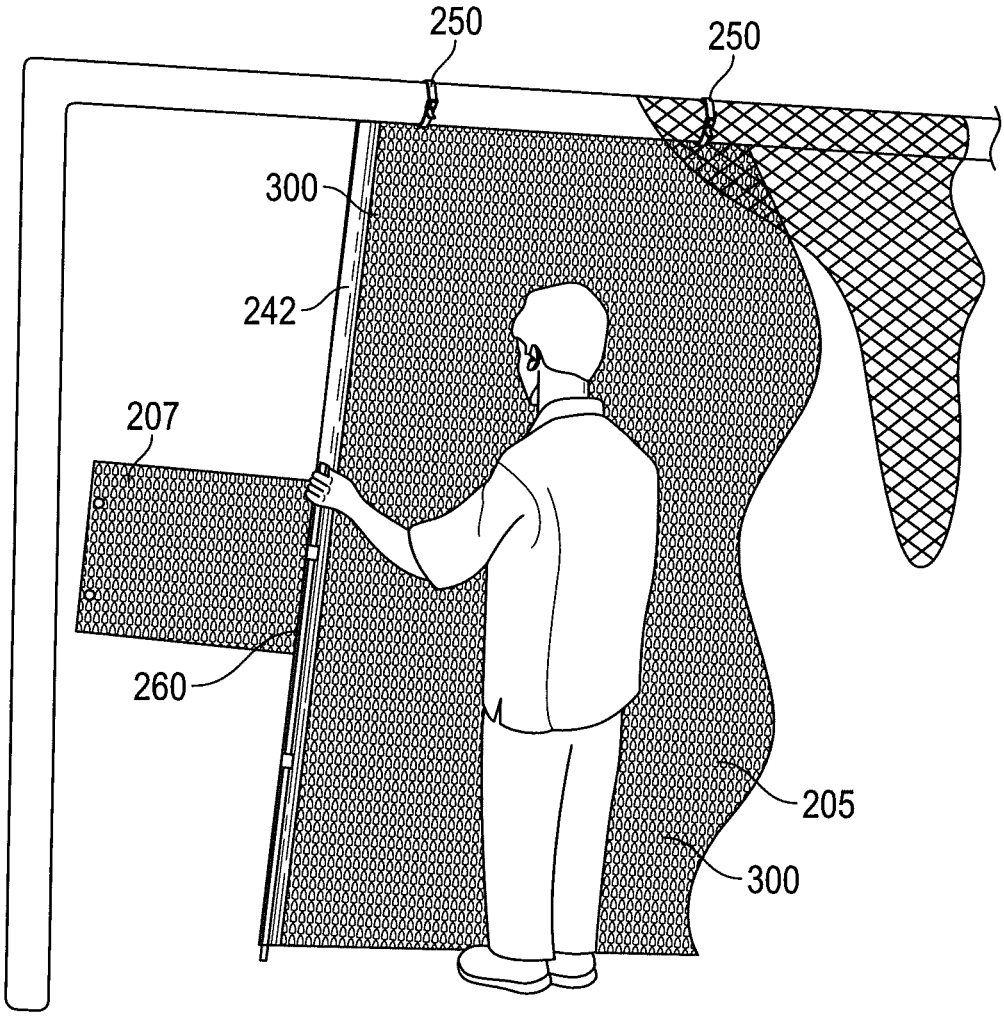
FIG. 8 is a perspective view of an exemplary embodiment of a method for connecting a soccer goal shot training device to a goal in accordance with the present disclosure.

As illustrated by embodiments in FIG. 8, support member 260 disposed in the vertical portion of goal cover 205 is accomplished after connection of goal shot training device 200 to goal 100. Insertion of support member 260 into receiver 242 is performed similarly as disclosed herein.

Figure 12A:
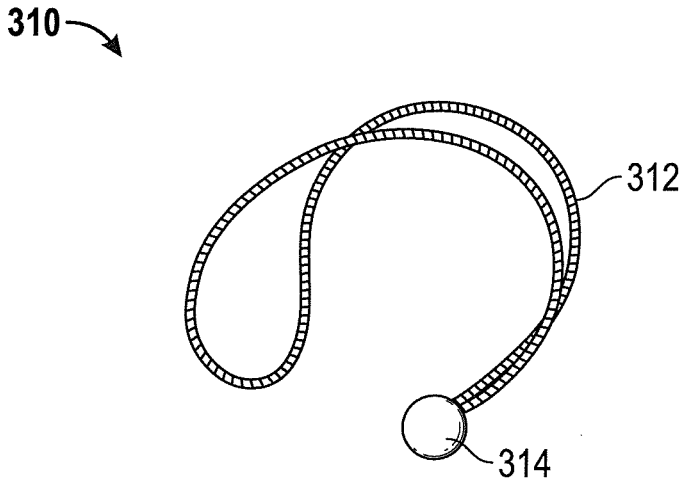
FIG. 12A is a perspective view of an exemplary embodiment of an attachment mechanism in accordance with the present disclosure.
Figure 12B:
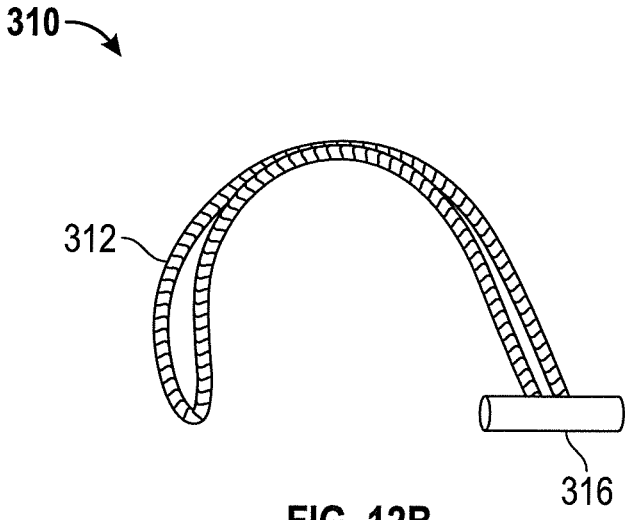
FIG. 12B is a perspective view of an exemplary embodiment of an attachment mechanism in accordance with the present disclosure.

With reference to FIGS. 12A and 12B, another exemplary attachment mechanism 310 is configured to be affixed around a top bar of a goal 100 and hold the training cover 205 in place relative to the goal. An exemplary attachment mechanism 310 includes a cord member 312 and a locking mechanism 314 slidably coupled to the cord member 312. More particularly, the cord member 312 forms a ring with the ends of the cord member inserted through the locking mechanism 314. Any type of cord and locking mechanism could be used so long as the attachment mechanism can is strong enough to hold the goal shot training device 200 to the goal 100. An exemplary attachment mechanism includes a ball locking mechanism 314, a cylindrical locking mechanism 316, as shown in FIG. 12B, or any other shaped component that can serve to lock the attachment mechanism to the goal posts as described herein.

In operation, the attachment mechanism 310 is inserted into openings in the top of the goal shot training device 200 and is also connected to upper cross bar 110 of the goal and optionally side posts 120, as would be known to a person of ordinary skill in the art for the purpose of hanging a curtain-like structure. Locking mechanism 314 or 316 is then drawn through the cord member 312 and the goal shot training device 200 is allowed to hang down until the cord member 312 closes tightly around the locking mechanism 314 or 316, thereby securing the goal shot training device 200.

Figure 9:
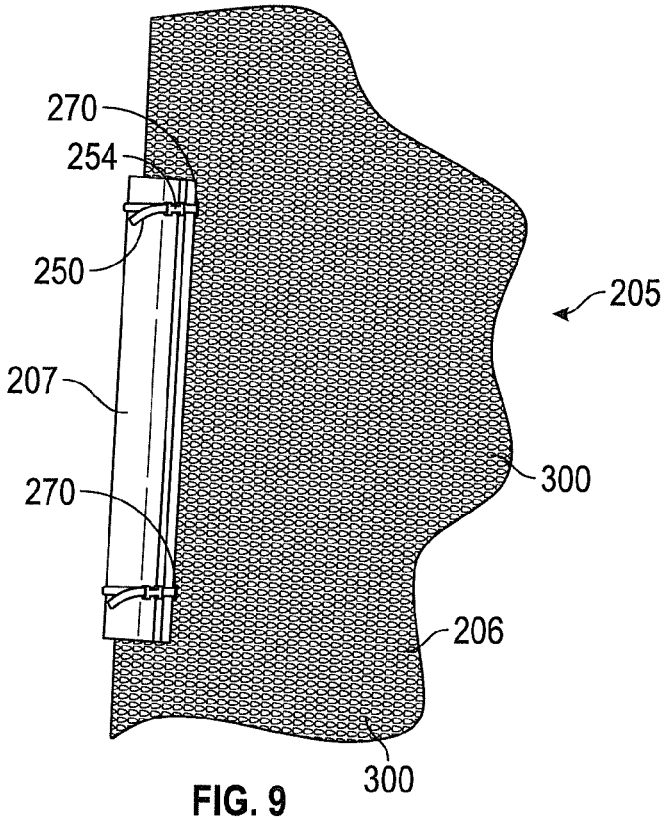
FIG. 9 is a perspective view of an exemplary embodiment of a goal shot training system in accordance with the present disclosure where a goal cover side extension is in a retracted position.

When goal cover side extensions 207 are not used, they may be stored behind goal cover 205. To store the desired goal cover side extension 207, it is rolled up towards the center of goal cover 205, as illustrated in FIG. 9. According to embodiments, there is shown goal cover 205 with goal cover side extension 207 in a retracted position. To retract, goal cover side extension 207 is rolled up. Straps 250 are inserted through securing openings 270 in goal cover 205 and wrapped around rolled up goal cover side extension 207 at one or more locations, according to embodiments. As illustrated in FIG. 9, two straps 250 secure rolled up goal cover side extension 207. Strap connectors 254 secure straps 250 thereby preventing goal cover side extension 207 from unrolling.

Figure 10:
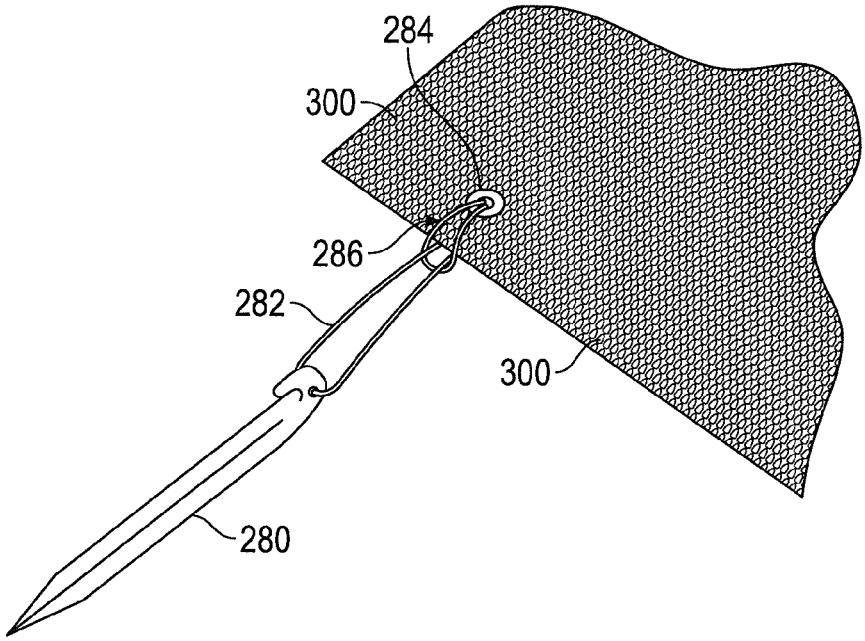
FIG. 10 is a perspective view of an exemplary embodiment of a stabilization system for a goal shot training system in accordance with the present disclosure when a goal cover side extension is in a retracted position.

When one or both goal cover side extensions 207 in a stored configuration, alternate securing devices may be used to secure goal shot training device 200 in a substantially fixed position relative to goal 100 (i.e., to overcome wind or the force of the ball kicked into goal shot training device 200), according to embodiments. For example and as illustrated in FIG. 10, securing device 280 coupled to securing connector 282 may be girth hitched 286 to securing opening 284 in goal cover 205. Securing device 280, according to embodiments, is an implement that is driven into the ground, such as a stake. Securing connector 282 is, according to embodiments, rope, cord, or other similar, but elastomeric devices, such as bungee. According to embodiments, securing opening 284 may be placed in each lower corner area of goal cover central portion 206. goal shot training device 200 may also be secured via rope, cord, bungee, and the like directly to goal posts 120, according to alternate embodiments.

Figure 13:
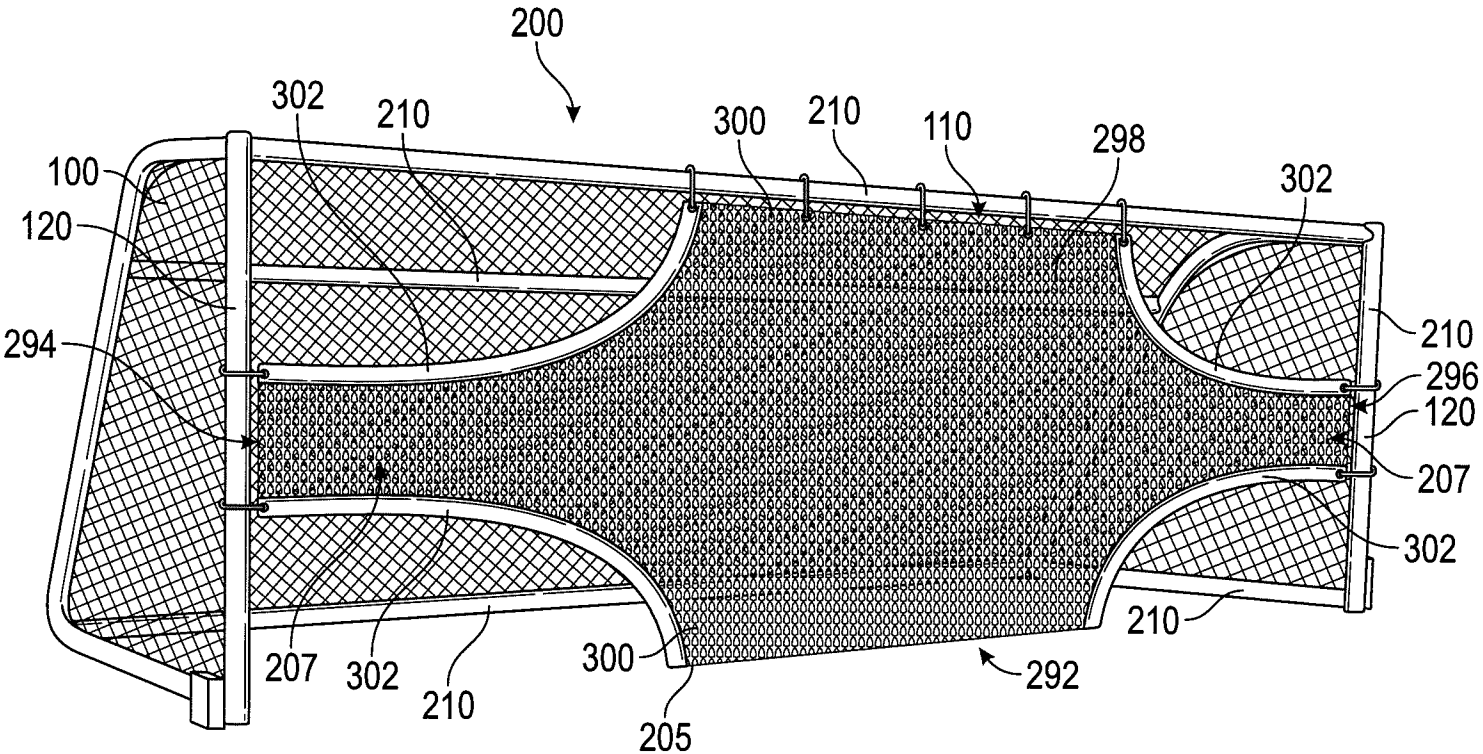
FIG. 13 is a perspective view of an exemplary embodiment of a goal shot training system in accordance with the present disclosure.
Figure 14:
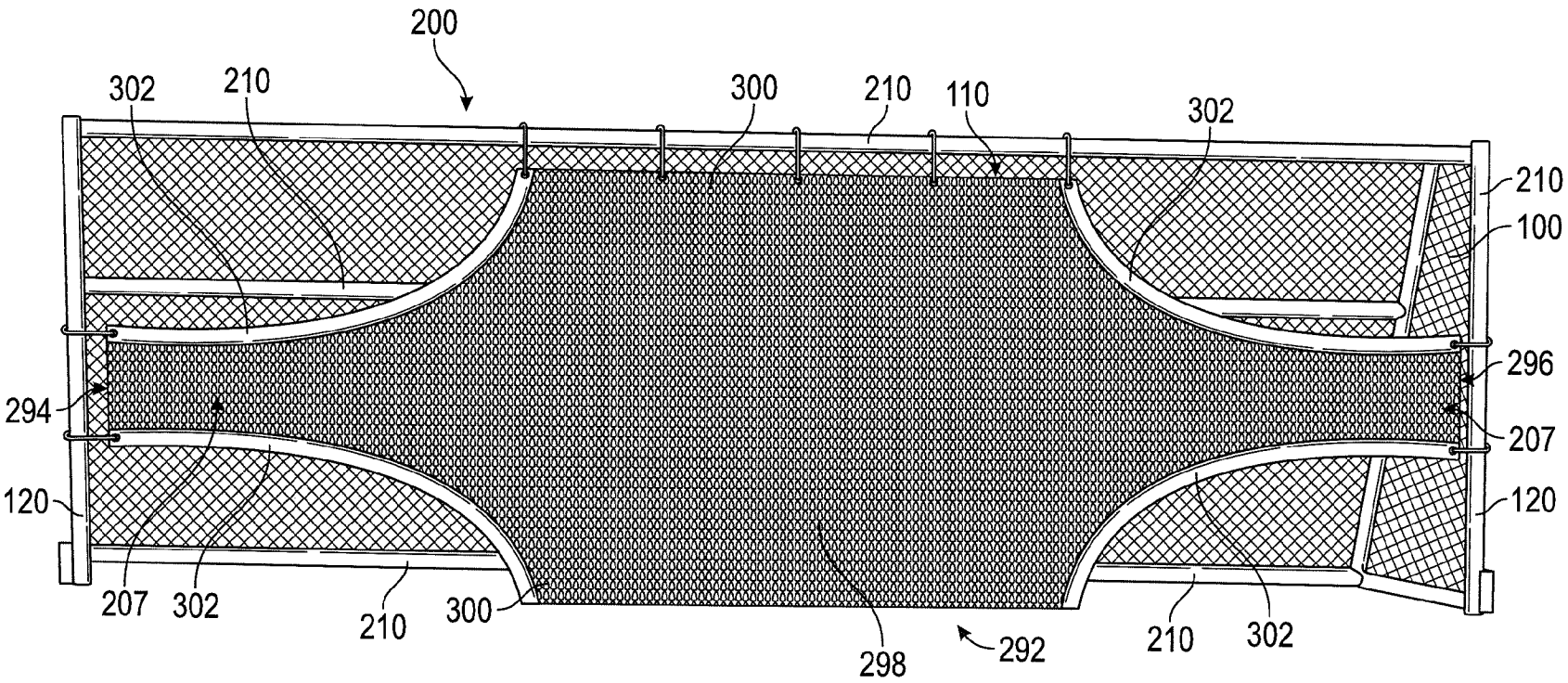
FIG. 14 is a front view of an exemplary embodiment of a goal shot training system in accordance with the present disclosure.

Turning to FIGS. 13 and 14, an exemplary embodiment of a goal shot training device 200 comprises a band 302 of material running along one or more side edges 294, 296 of the training covering 205 and/or between side edges 294, 296 and top and bottom edges 290, 292. An exemplary band 302 is made of material having a color that creates a significant visual distinction with the dark color of the knit material 298. For instance, the band 302 of material may be brightly colored in green, yellow, orange or other colors. The band 302 may run along the side edges, 294, 296 of the training covering 205, and/or may run between side edges 294, 296 and top and bottom edges 290, 292. Multiple arrangements and layouts of the colored band 302 are possible so long as the band creates a significant visual distinction with the dark color of the knit material 298. This distinction created by the band 302 advantageously attracts the visual attention of the practicing player and enhances the training of the player. More particularly, the player sees the brightly colored band 302 and is thus more likely to shoot the ball, puck or other object to the positive viewing spaces 210.

The present disclosure also discloses a method of conditioning soccer players to improve their shooting and increase the likelihood of successful shots on goal 100. The method uses positive viewing spaces 210 and negative viewing spaces 220 to condition players to shoot towards the areas of the goal 100 defined by the positive viewing spaces 210. More specifically, goal shot training device 200 is provided. goal shot training device 200 includes both positive viewing spaces 210 and negative viewing spaces 220, as previously described. Once installed in goal 100, players set up and shoot soccer balls towards the goal, aiming at the positive viewing spaces 210. In embodiments, goal shot training device 200 is used over an extended time to condition the player to look first to positive viewing spaces 210 of goal 100, even in the absence of goal shot training device 200. As players practice using goal shot training device 200, they will become conditioned to shoot at the areas of goal 100 that are most likely to produce scores.

Moreover, the present disclosure teaches a business method for generating revenues. According to embodiments, goal shot training device 200 may be produced for improving the skills of soccer players. Naturally, professional and semi-professional soccer clubs would value a training system that would increase the number of goals scored. As the number of goals scored increases, the number of wins a team is likely to produce will tend to increase, which will induce fans to attend games and purchase goods and services related to the soccer club. Thus, professional clubs stand to increase revenues by conditioning players to shoot first at the areas of the goal most likely to produce a scoring event.

Moreover, according to the teachings of similar methods, providing goal shot training device's 200 to children and young adult soccer players would improve their skills and make them more likely to be selected for specialized teams, play for college teams, earn scholarships, and to eventually become professional players. Thus, conditioning children and young adults to increase the likelihood of scoring goals using goal shot training device 200 is an additional value imparted by the teachings of the present disclosure.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

Thus, it is seen that goal shot training systems, devices and methods are provided. It should be understood that any of the foregoing configurations and specialized components or chemical compounds may be interchangeably used with any of the systems of the preceding embodiments. Although illustrative embodiments are described hereinabove, it will be evident to one skilled in the art that various changes and modifications may be made therein without departing from the disclosure. It is intended in the appended claims to cover all such changes and modifications that fall within the true spirit and scope of the disclosure.

The invention claimed is:

1. A goal shot training device comprising:

a training covering having a top edge, a bottom edge, and side edges and being configured to obscure a net of a goal, the covering being substantially cross-shaped, the cross-shape having a pair of arms extending laterally from a body of the covering that extends substantially from the ground to a crossbar of a goal, the covering composed of a knit material defining multiple openings such that air passes through the covering, each opening being substantially egg-shaped or substantially tear-drop-shaped, the knit material creating negative space by obscuring visual access behind the training covering and forming at least one user-configurable opening that allows visual access of positive space including a portion of the net of the goal when the covering is affixed to the goal;

wherein a user may configure the covering to practice shots originating from different positions on a playing area by adjusting the location of the covering relative to the net of the goal and may configure the covering to mimic the range of a goal keeper by at least one of adjusting the location of the body of the covering relative to posts of a goal, and removing or folding one or both arms whereby the arm no longer obscures the net;

wherein when the covering is affixed to the goal, the combination of the covering and goal comprises at least:

a configuration for shots originating substantially directly in front of the goal consisting of positioning the body and arms of the covering whereby the covering obscures the net except for openings at the top right corner, the top left corner, the bottom right corner, and the bottom left corner of the goal;

a configuration for shots originating at a penalty kick position consisting of positioning the covering whereby the covering obscures the net except for a pair of openings are created along each post from the ground to the cross bar; and a configuration for shooting shots from the side of the field consisting of positioning the covering whereby the covering obscures the net except for an opening created along the post furthest from the origin of the shot, the opening being from the ground to the cross bar.

2. The training device of claim 1 further comprising a band of brightly colored material running between at least one side edge and a top or bottom edge of the covering.

3. The training device of claim 1 wherein the covering is translucent.

4. The training device of claim 1 wherein the covering further comprises an attachment mechanism configured to be affixed around a top bar of a goal and hold the training cover in place relative to the goal.

5. The training device of claim 1 wherein the knit material is opaque.

6. A goal shooting training system in combination with a goal, comprising:

a goal cover adapted to be used in combination with a goal having two upright posts of equal height, a crossbar having two endpoints, each endpoint terminating at each upright post respectively, and a net affixed to the goal, wherein the crossbar is parallel to the ground at a height equal to the height of the posts;

the goal cover having a top edge, a bottom edge, and side edges and being configured to obscure a net of a goal, the goal cover being substantially cross-shaped, the cross-shape having a pair of arms extending laterally from a body of the goal cover that extends substantially from the ground to a crossbar of a goal, the goal cover composed of a knit material defining multiple openings such that air passes through the goal cover, each opening being substantially egg-shaped or substantially tear-drop-shaped, the goal cover obscuring a majority of the net from view from a playing area, the knit material being of a color that creates a visual contrast with a minority portion of the net that is viewable from a playing area;

wherein the user may configure the goal cover to mimic the range of a goal keeper by at least one of adjusting the location of the body of the goal cover relative to posts of a goal, and removing or folding one or both arms whereby the arm no longer obscures the net;

wherein when the goal cover is affixed to the goal, the combination of the goal cover and goal comprises at least:

a configuration for shots originating substantially directly in front of the goal consisting of positioning the body and arms of the goal cover whereby the goal cover obscures the net except for openings at the top right corner, the top left corner, the bottom right corner, and the bottom left corner of the goal;

a configuration for shots originating at a penalty kick position consisting of positioning the goal cover whereby the goal cover obscures the net except for a pair of openings are created along each post from the ground to the cross bar; and a configuration for shooting shots from the side of the field consisting of positioning the goal cover whereby the goal cover obscures the net except for an opening created along the post furthest from the origin of the shot, the opening being from the ground to the cross bar.

7. The goal shooting training system of claim 6 wherein the knit material is opaque.

8. The goal shooting training system of claim 6 further comprising a band of brightly colored material running between at least one side edge and a top or bottom edge of the covering.

9. The goal shooting training system of claim 6 wherein the goal cover maintains its original position when air passes through the openings in the knit material.

10. A goal shot training device comprising:

a training covering having a top edge, a bottom edge, and side edges and being configured to obscure a net of a goal, the covering being substantially cross-shaped, the cross-shape having a pair of arms extending laterally from a body of the covering that extends substantially from the ground to a crossbar of a goal, the covering composed of a knit material defining multiple substantially teardrop-shaped openings such that air passes through the covering, the knit material creating negative space by obscuring visual access behind the training covering and forming at least one user-configurable opening that allows visual access of positive space including a portion of the net of the goal when the covering is affixed to the goal;

wherein a user may configure the covering to mimic the range of a goal keeper by at least one of adjusting the location of the body of the covering relative to posts of a goal, and removing or folding one or both arms whereby the arm no longer obscures the net;

wherein when the covering is affixed to the goal, the combination of the covering and goal comprises at least:

a configuration for shots originating substantially directly in front of the goal consisting of positioning the body and arms of the covering whereby the covering obscures the net except for openings at the top right corner, the top left corner, the bottom right corner, and the bottom left corner of the goal;

a configuration for shots originating at a penalty kick position consisting of positioning the covering whereby the covering obscures the net except for a pair of openings are created along each post from the ground to the cross bar; and a configuration for shooting shots from the side of the field consisting of positioning the covering whereby the covering obscures the net except for an opening created along the post furthest from the origin of the shot, the opening being from the ground to the cross bar.

* * * * *